US008177083B2

(12) United States Patent
Lamoureux et al.

(10) Patent No.: US 8,177,083 B2
(45) Date of Patent: May 15, 2012

(54) THREADLESS CAP WITH A NONINTEGRAL SEAL

(75) Inventors: Richard Lamoureux, Raudon (CA); Gérard Perrin, Meyzieu (FR); Henri Pionchon, Lyons (FR)

(73) Assignee: Tetra Laval Holdings & Finance S.A., Pully (CH)

( * ) Notice: Subject to any disclaimer, the term of this patent is extended or adjusted under 35 U.S.C. 154(b) by 1047 days.

(21) Appl. No.: 11/440,720

(22) Filed: May 24, 2006

(65) Prior Publication Data

US 2007/0023383 A1 Feb. 1, 2007

Related U.S. Application Data

(63) Continuation-in-part of application No. 10/822,211, filed on Apr. 8, 2004, now Pat. No. 7,581,653.

(51) Int. Cl.
*B65D 41/00* (2006.01)

(52) U.S. Cl. ..... 215/320; 215/255; 215/257; 215/378

(58) Field of Classification Search ..... 215/255, 215/257, 320, 378
See application file for complete search history.

(56) References Cited

U.S. PATENT DOCUMENTS

| | | | | |
|---|---|---|---|---|
| 1,197,007 | A | 10/1934 | Cullen et al. | |
| 2,213,465 | A | 9/1940 | Gay | |
| 2,811,272 | A | 10/1957 | Lawlor | |
| 3,392,862 | A * | 7/1968 | Faulstich | 215/254 |
| 3,840,137 | A * | 10/1974 | Faulstich | 215/256 |
| 3,866,783 | A * | 2/1975 | Bullock et al. | 215/254 |
| 3,940,103 | A | 2/1976 | Hilaire | |
| 3,974,932 | A * | 8/1976 | Faulstich | 215/256 |
| 4,106,653 | A * | 8/1978 | Martinelli | 215/256 |
| 4,162,736 | A * | 7/1979 | Faulstich | 215/256 |
| 4,166,552 | A * | 9/1979 | Faulstich | 215/256 |
| 4,239,130 | A | 12/1980 | Altadonna | |
| 4,243,150 | A | 1/1981 | Gunne et al. | |
| 4,267,945 | A | 5/1981 | Maynard, Jr. | |
| 4,577,771 | A * | 3/1986 | Martinez | 215/256 |
| 4,597,423 | A | 7/1986 | Chenot | |
| RE32,354 | E | 2/1987 | Savage | |
| 4,699,188 | A | 10/1987 | Baker et al. | |
| 4,717,051 | A | 1/1988 | Leclere | |
| 4,784,296 | A * | 11/1988 | Bullock | 222/153.07 |

(Continued)

FOREIGN PATENT DOCUMENTS

CA 1 291 969 11/1991

(Continued)

*Primary Examiner* — Anthony Stashick
*Assistant Examiner* — Christopher McKinley
(74) *Attorney, Agent, or Firm* — Miller, Matthias & Hull LLP

(57) ABSTRACT

A threadless cap for closing a liquid bottle, the liquid bottle having a neck with an upper edge defining a discharge opening. The threadless cap comprises a lid for overlying the upper edge, the lid including a surface for facing the upper edge and a projection extending from the surface toward the upper edge. The threadless cap also comprises a skirt depending from the lid. The threadless cap further comprises a seal member on the surface for establishing a sealing engagement with the upper edge. The seal member includes an arcuate bead of resilient material located on the surface in a position to register with at least a portion of the upper edge. The projection engages and extends along the arcuate bead of resilient material. A blank for such a threadless cap and a method for manufacturing such a threadless cap are also provided.

31 Claims, 5 Drawing Sheets

U.S. PATENT DOCUMENTS

| | | | | | |
|---|---|---|---|---|---|
| 4,815,617 | A | * | 3/1989 | Cullum | 215/232 |
| 4,834,267 | A | | 5/1989 | Schroer et al. | |
| 4,846,236 | A | | 7/1989 | Deruntz | |
| 4,911,316 | A | * | 3/1990 | Tackles | 215/256 |
| 4,934,546 | A | * | 6/1990 | Markley | 215/256 |
| 4,948,009 | A | | 8/1990 | Sawatani | |
| 5,031,676 | A | | 7/1991 | Ulm | |
| 5,121,778 | A | | 6/1992 | Baker et al. | |
| 5,222,519 | A | | 6/1993 | Sato et al. | |
| 5,222,530 | A | | 6/1993 | Baker et al. | |
| 5,224,616 | A | * | 7/1993 | Crisci | 215/256 |
| 5,232,125 | A | | 8/1993 | Adams | |
| 5,259,534 | A | | 11/1993 | Lynd | |
| 5,273,083 | A | | 12/1993 | Burrows | |
| 5,284,188 | A | | 2/1994 | Baker et al. | |
| 5,289,854 | A | | 3/1994 | Baker et al. | |
| 5,289,855 | A | | 3/1994 | Baker et al. | |
| 5,295,518 | A | | 3/1994 | Baker et al. | |
| 5,297,599 | A | | 3/1994 | Bucheli | |
| 5,370,270 | A | * | 12/1994 | Adams et al. | 222/88 |
| 5,397,023 | A | | 3/1995 | Toczek et al. | |
| 5,513,763 | A | | 5/1996 | Adams et al. | |
| 5,542,555 | A | * | 8/1996 | Hidding et al. | 215/265 |
| 5,687,865 | A | * | 11/1997 | Adams et al. | 215/253 |
| 5,687,867 | A | | 11/1997 | Lamoureux | |
| 5,909,827 | A | * | 6/1999 | Bietzer et al. | 222/83.5 |
| 6,032,812 | A | | 3/2000 | Lamoureux | |
| 6,082,567 | A | * | 7/2000 | Bietzer et al. | 215/256 |
| 6,102,226 | A | * | 8/2000 | Verderber | 215/254 |
| 6,177,041 | B1 | | 1/2001 | Bietzer | |
| 6,237,790 | B1 | * | 5/2001 | Verderber | 215/254 |
| 6,283,331 | B1 | * | 9/2001 | Lucas | 222/153.03 |
| 6,338,414 | B1 | * | 1/2002 | Schellenbach | 215/252 |
| 6,626,310 | B2 | * | 9/2003 | Taha | 215/252 |
| 6,681,947 | B2 | * | 1/2004 | Kim et al. | 215/254 |
| 7,007,816 | B2 | * | 3/2006 | Verderber | 215/254 |
| 7,228,980 | B2 | * | 6/2007 | Morini | 215/253 |
| 7,281,636 | B2 | * | 10/2007 | Kim et al. | 215/254 |
| 7,581,653 | B2 | * | 9/2009 | Perrin et al. | 215/254 |
| 2001/0037989 | A1 | * | 11/2001 | Verderber | 215/254 |
| 2002/0113032 | A1 | * | 8/2002 | Blomdahl et al. | 215/341 |
| 2002/0195414 | A1 | * | 12/2002 | Kim et al. | 215/254 |
| 2003/0094213 | A1 | | 5/2003 | Moon et al. | |
| 2003/0150834 | A1 | * | 8/2003 | Verderber | 215/254 |
| 2004/0129667 | A1 | * | 7/2004 | Nusbaum et al. | 215/250 |

FOREIGN PATENT DOCUMENTS

| | | | |
|---|---|---|---|
| CA | 1 338 210 | | 4/1996 |
| CA | 1 338 339 | | 5/1996 |
| CA | 2 181 828 | | 1/2002 |
| CA | 2 442 213 | | 10/2002 |
| CA | 2 418 456 | | 8/2004 |
| EP | 0 918 731 | B1 | 6/1997 |
| FR | 2 822 810 | A1 | 3/2001 |
| GB | 1 104 638 | | 3/1966 |
| WO | WO 90/03919 | | 4/1990 |
| WO | WO 91/13813 | | 9/1991 |
| WO | WO 93/07084 | | 4/1993 |
| WO | WO 94/29215 | | 12/1994 |
| WO | WO 98/03426 | | 1/1998 |
| WO | WO 00/40474 | | 7/2000 |
| WO | WO 02/060808 | A1 | 8/2002 |
| WO | WO 02/079046 | A1 | 10/2002 |
| WO | WO 2004/071932 | A1 | 8/2004 |

* cited by examiner

THREADLESS CAP WITH A NONINTEGRAL SEAL

CROSS-REFERENCE TO RELATED APPLICATION

This application is a continuation-in-part of U.S. patent application Ser. No. 10/822,211 filed on Apr. 8, 2004 by Perrin et al. and hereby incorporated by reference herein.

FIELD OF THE INVENTION

The present invention relates to a threadless cap for closing a liquid bottle, such as a water bottle for a water dispenser.

BACKGROUND

A potable liquid bottle, such as a water bottle for a water cooler or similar dispenser, is usually provided with a cap to close and seal a discharge opening on a neck of the bottle during storage, transportation, and manipulation of the bottle. Of course, other than water, the potable liquid contained in the bottle can also be juice, soft drink, or any other type of drinkable liquid.

The cap prevents inadvertent spilling of liquid from the bottle and contamination of the liquid by exposure to the environment. The cap also ensures that hygienic conditions exist on surfaces of the neck of the bottle and around the discharge opening on which liquid flowing out of the bottle will come into direct contact with. Typically, the cap is made of a polymer material and includes a tension ring or the like that provides a radial force for retaining the cap on the neck of the bottle. The cap also generally includes a line of weakness that facilitates tearing or rupturing of the cap material by a manual pull when the cap is to be removed from the bottle.

To adequately seal the bottle, the cap may have a nonintegral resilient seal which engages the upper edge of the bottle neck and thus seals the discharge opening. By "nonintegral" is meant a resilient seal that is distinct from the remainder of the cap and mounted to the cap to perform the sealing function. The nonintegral resilient seal can be formed directly on the cap by laying a bead of polymer material which becomes resilient when it sets.

The manufacturing of such a nonintegral seal faces a number of challenges. On one hand, there is the need to reduce as much as possible the amount of polymer material used to form the resilient seal in order to lower the cost of production of the cap. At the same time, when less polymer material is used, the integrity of the resilient seal may be compromised. This is particularly important when the threadless cap is used to close large water bottles that are made of plastic material, where significant dimensional variations can exist between different brands or models of bottles in the area of the bottle neck. For such applications, it is important to provide caps with good sealing ability capable to accommodate bottles with significant dimensional variations.

Accordingly, there is a clear need in the industry to provide an improved threadless cap for closing a liquid bottle that uses a nonintegral cap and that provides an effective sealing function.

SUMMARY OF THE INVENTION

According to a first broad aspect, the invention provides a threadless cap for closing a liquid bottle, the liquid bottle having a neck with an upper edge defining a discharge opening. The threadless cap comprises a lid for overlying the upper edge, the lid including a surface for facing the upper edge and a projection extending from the surface toward the upper edge. The threadless cap also comprises a skirt depending from the lid. The threadless cap further comprises a seal member on the surface for establishing a sealing engagement with the upper edge. The seal member includes an arcuate bead of resilient material located on the surface in a position to register with at least a portion of the upper edge. The projection engages and extends along the arcuate bead of resilient material.

According to a second broad aspect, the invention provides a blank for a threadless cap, the threadless cap for use in closing a liquid bottle, the liquid bottle having a neck with an upper edge defining a discharge opening. The blank comprises a lid for overlying the upper edge and a skirt depending from the lid. The lid includes a surface for facing the upper edge and a channel on the surface for receiving an arcuate bead of polymer material capable of setting to form a resilient seal member. The channel is located on the surface in a position to register with at least a portion of the upper edge. The channel includes a projection extending from the surface toward the upper edge, the projection defining a barrier to prevent the polymer material deposited in the channel from flowing laterally out of the channel.

According to a third broad aspect, the invention provides a method for manufacturing a threadless cap for closing a liquid bottle having a neck with an upper edge defining a discharge opening. The method comprises providing a threadless cap blank including a lid for overlying the upper edge, the lid including an arcuate channel located on the lid in a position to face the upper edge and register with at least a portion of the upper edge. The method also comprises flowing in the channel a bead of polymer material, the polymer material when setting forming a resilient seal member suitable for sealingly engaging the upper edge. The channel constrains the polymer material to flow along a length of the channel and impedes the polymer material from flowing laterally out of the channel.

According to a fourth broad aspect, the invention provides method for manufacturing a threadless cap for a liquid bottle that has a neck with an upper edge defining a discharge opening. The method comprises molding a blank having a lid for overlying the upper edge. The method also comprises depositing on a sealing face of the lid a ring-shaped bead of polymer material, the polymer material, when set, forming a resilient seal member suitable for sealingly engaging the upper edge. The method further comprises constraining laterally the bead of polymer material to impede the polymer material from flowing in a radial direction with relation to the ring-shaped bead.

These and other aspects and features of the invention will now become apparent to those of ordinary skill in the art upon review of the following description of certain embodiments of the invention in conjunction with the accompanying drawings.

BRIEF DESCRIPTION OF THE DRAWINGS

A detailed description of certain examples of implementation of the present invention is provided below with reference to the following drawings in which.

Figure 1B:
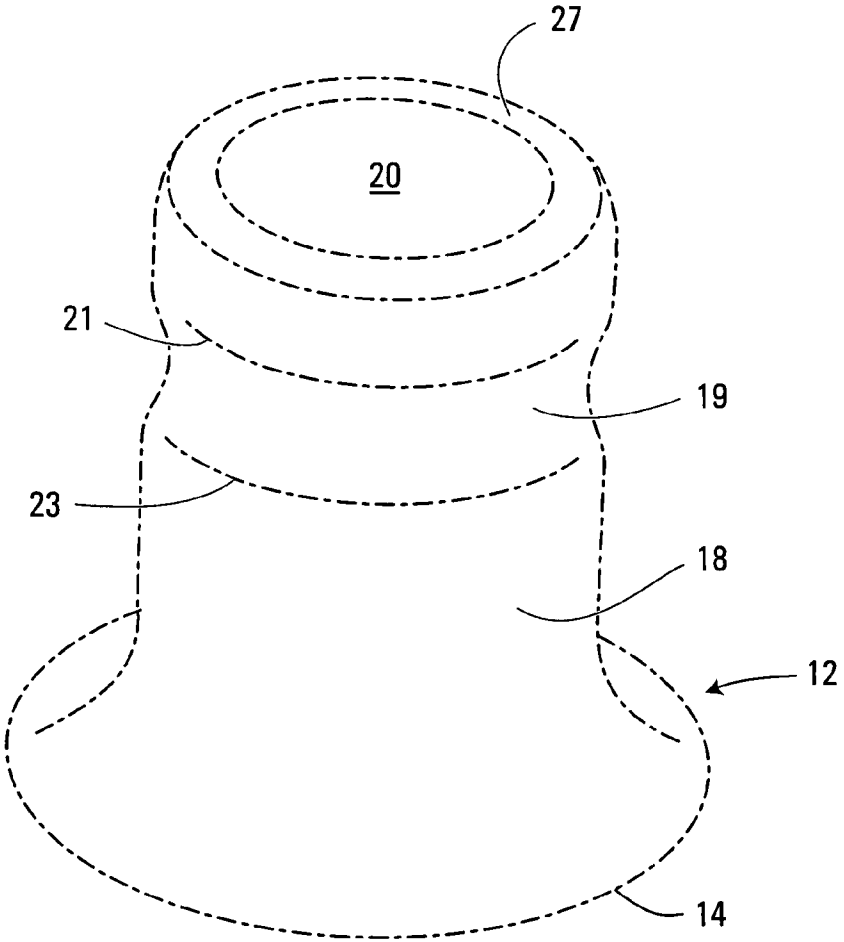
FIG. 1B shows an isometric view of the neck of the liquid bottle shown in FIG. 1A.

In the drawings, embodiments of the invention are illustrated by way of example. It is to be expressly understood that the description and drawings are only for purposes of illustration and are an aid to understanding. They are not intended to be a definition of the limits of the invention.

DETAILED DESCRIPTION OF EMBODIMENTS

Figure 1A:
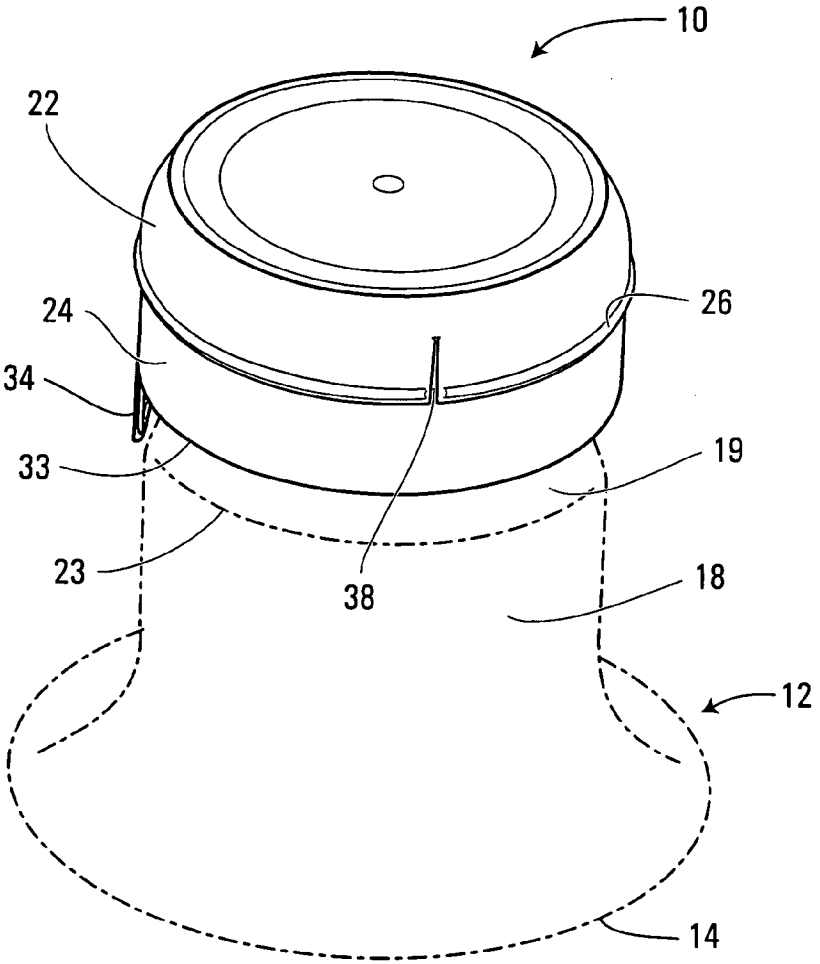
FIG. 1A shows an isometric view of a threadless cap for closing a liquid bottle in accordance with a specific example of implementation of the present invention.

FIG. 1A shows a threadless cap 10 for closing a liquid bottle 12 in accordance with a specific example of implementation of the invention. In this specification, threadless is intended to mean that the cap 10 does not have threads that are required to retain the cap 10 on the liquid bottle 12. The liquid contained in the bottle 12 can be water, juice, soft drink, or any other type of drinkable liquid. In the specific embodiments described in the present description, the liquid bottle 12 on which the cap 10 is to be mounted is a bottle for a water cooler or other liquid dispenser.

As can be seen in FIG. 1B, the liquid bottle 12 has a main body 14 defining a container (not shown) for holding liquid. The bottle 12 also has a neck 18 having an upper edge 27 defining a discharge opening 20 through which liquid contained in the container can be discharged, and an annular recessed area 19 below the upper edge 27. The annular recessed area 19, which extends around the perimeter of the neck 18, has an upper end portion 21 and a lower end portion 23. Upon installation of the bottle 12 in a dispenser (not shown), actuation of the dispenser by a user causes liquid contained in the container to flow through the discharge opening 20 into the dispenser and eventually through a faucet of the dispenser, where the liquid can be poured into a glass, cup, or the like.

Referring to FIGS. 1A and 1B and to FIGS. 2 to 5, the cap 10 comprises a lid 22 for overlying and sealingly engaging the upper edge 27 of the neck 18 of the bottle 12 and a skirt 24 depending from the lid 22. In the specific embodiment shown, the lid 22 and the skirt 24 are a unitary structure made of a polymer material such as polyethylene. The lid 22 and the skirt 24 can be integrally formed, for instance, via an injection molding process. The cap 10 is provided with a nonintegral resilient seal member 11 to seal the upper edge 27 in use. The structure and method of manufacture of the seal member 11 will be discussed in greater detail later.

The lid 22 includes a tension ring 26 for retaining the cap 10 on the neck 18 of the bottle 12. Upon positioning the cap 10 on the neck of the bottle 12, the tension ring 26 provides a radial force that causes the cap 10 to be retained on the neck 18. The tension ring 26 has an inwardly extending rib 28 for engaging the neck 18 of the bottle 12. The rib 28 is an internal projection or protrusion. In the non-limiting example of implementation shown, the rib 28 is in the form of a continuous projection extending along a substantial portion of the perimeter of the lid 22. In other embodiments, the rib 28 can be segmented, that is, the rib 28 can be formed of individual segments disposed along the periphery of the lid 22 rather than a continuous structure. Also, in this specific example of implementation, the tension ring 26 extends over substantially the entire periphery of the lid 22, although it is to be understood that the tension ring 26 can also be designed to extend along only a limited portion of the periphery of the lid 22. As well, while the lid 22 shown in FIGS. 1A to 5 is essentially a circular structure, it will be appreciated that various other configurations are possible without departing from the spirit of the invention.

Figure 5:
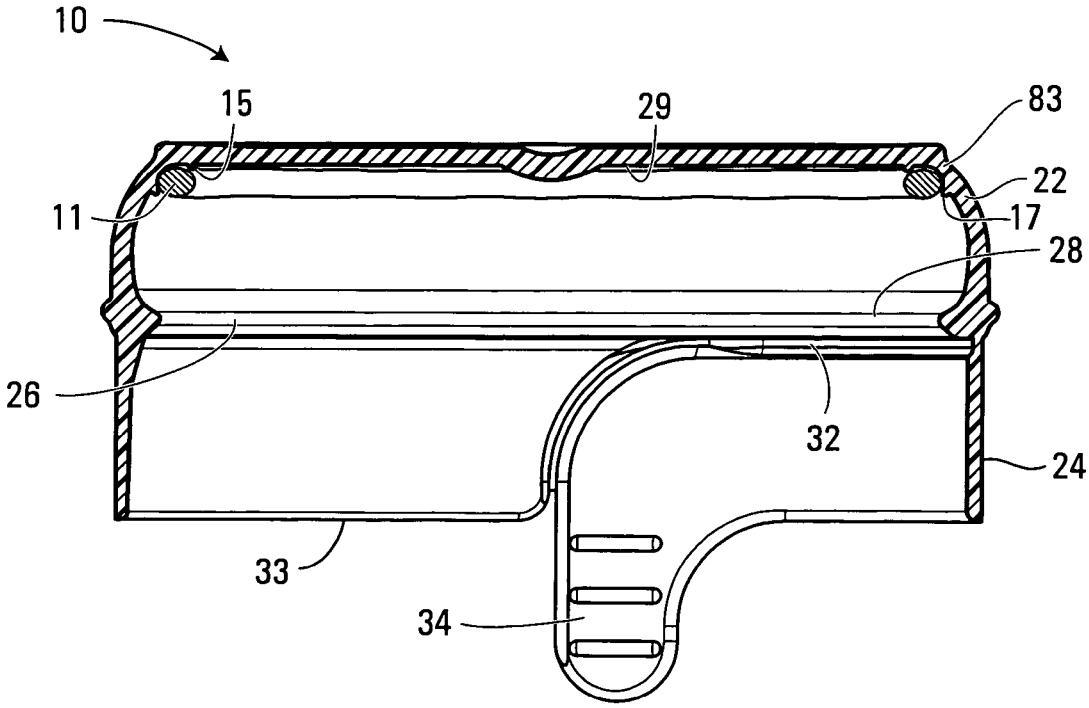
FIG. 5 shown a cross-sectional elevation view of the threadless cap along line 5-5 in FIG. 4.

In FIG. 5, the cross-sectional view of the cap 10 shows that the thickness of the cap 10 in a shoulder area 83 is somewhat reduced by comparison to prior art caps in order to increase the flexibility of the cap 10 in that region. This allows the rib 28 to project radially inwardly further such as to create a stronger retention force on the neck 18 of the bottle 12. The cap 10 is applied on the neck 18 of the bottle 12 by a snap-on action, in other words the tension ring 26 is progressively spread radially until it snaps into place. The increased flexibility of the shoulder area 83 allows the thicker retention ring to be conveniently applied on the neck 18 of the bottle 12.

The skirt 24 depends from the lid 22 and surrounds the neck 18 of the bottle 12 when the cap 10 is installed thereon. In the particular embodiment shown, the skirt 24 has a lower edge 33 and is dimensioned such that when the cap 10 sealingly engages the upper edge of the neck 18, the lower edge 33 of the skirt 24 is at the level of or below the lower end portion 23 of the annular recessed area 19 of the neck 18 of the bottle 12. This may assist in preventing tampering.

The skirt 24 includes a line of weakness 32 facilitating a manual tear of the skirt 24. The line of weakness 32 is a line along which the skirt material is likely to tear or rupture when the skirt 24 is pulled. In the non-limiting example of implementation shown in FIGS. 1A to 5, the line of weakness 32 is realized by making the skirt material thinner along a certain line selected to be the line of weakness 32 than at other portions of the skirt 24. Alternatively, the line of weakness 32 can be realized by making a series of indentations or a series of perforations in the skirt material along a certain line selected to be the line of weakness 32. In the specific embodiment shown, the line of weakness 32 extends along a portion of the periphery of the skirt 24 in the vicinity of the tension ring 26. More specifically, the line of weakness 32 extends along approximately three-quarters of the periphery of the skirt 24 in an area adjacent to the tension ring 26. Furthermore, in this case, the line of weakness 32 includes a portion 38 extending across the tension ring 26. When the skirt 24 is torn and the material is ruptured at the portion 38, the tension ring 26 is severed which reduces its ability to hold the cap 10 on the bottle 12.

In addition, in the non-limiting embodiment shown, the skirt 24 defines a pull tab 34 for facilitating a manual tear of the skirt material along the line of weakness 32 when the cap 10 is removed from the bottle 12. The pull tab 34 projects down and depending on its size may extend down past the lower end portion 23 of the annular recessed area 19.

In the particular example of implementation shown in FIGS. 1A to 5, the cap 10 further comprises a tear stop 36 at a location intersecting a line of tear propagating as a result of a manual pull applied on the skirt 24. The line of tear produced by a manual pull of the skirt 24 is most likely to follow the line of weakness 32 of the skirt 24. The tear stop 36 prevents the line of tear to propagate beyond the tear stop 36. More specifically, the tear stop 36 is a structure adapted to prevent propagation of the line of tear beyond the location of the structure. In the specific embodiment shown, the tear stop 36 includes a thickened portion on the cap 10. More specifically, the tear stop 36 is realized by a thickening of the skirt material in a certain area of the skirt 24. Thickening of the skirt material is intended to mean that the skirt material in that certain area of the skirt 24 is thicker than in adjacent areas of the skirt 24 through which the line of weakness 32 extends. Once the propagating line of tear reaches the tear stop 36, the thicker material of the skirt 24 at that location will prevent further tearing of the skirt material without a significant increase in the pulling force applied on the skirt 24. In other embodiments, the tear stop 36 can be realized by forming a hole of sufficient dimensions in the skirt material. When the tear reaches such a tear stop 36, the absence of material in the hole negates availability of material through which the tear can propagate and thus prevents further propagation of the tear beyond that location.

In order to remove the cap 10 from the neck of the bottle, the user first grasps the pull tab 34. By applying sufficient pulling force on the pull tab 34, the skirt 24 will start tearing from the remainder of the cap 10 along the line of weakness 32. As the pulling force is maintained on the skirt 24 the tear propagates along the tension ring 26 and as the tear reaches the portion 38 it extends through the tension ring 26, thus rupturing the tension ring 26. At this point the tear stops propagating since the tear stop 36 is reached. When the tear stop 36 has been reached, the skirt 24 is still attached to the remainder of the cap 10 since, as indicated earlier, the line of weakness 32 extends around the cap 10 over an angular distance that is less than 360 degrees. It suffices then for the user to pull the skirt 24 up so as to remove the entire cap 10 from the neck of the bottle. This is easily feasible since the tension ring 26 has been ruptured and it applies only a relatively weak grip on the neck of the bottle.

It will thus be appreciated that the tension ring 26, the line of weakness 32, and the tear stop 36 facilitate the mounting, retention, and removal of the cap 10 on or from the neck 18 of the bottle 12. In particular, the tension ring 26 facilitates installation and ensures retention of the cap 10 on the neck 18 of the bottle 12. For their part, the line of weakness 32, the portion 38 of the line of weakness 32 and the tear stop 36 facilitate the removal of the cap 10 from the neck 18 of the bottle 12. The benefit of preventing a complete removal of the skirt 24 from the remainder of the cap 10 is two fold. First, the skirt 24 forms a convenient handle for the user to separate the cap 10 from the bottle neck. Hence, there is no need to use fingernails or tools to pry the cap off the bottle neck. Second, the cap always remains as one piece and it is thus easier to dispose in light of the fact that there is no complete separation of the skirt 24.

The structure of the resilient seal member 11 is best shown in FIG. 5. The resilient seal member 11 includes an arcuate bead of resilient material, which in this non-limiting example of implementation is ring-shaped and centered on the lid 22. The resilient seal member 11 is positioned on the lid 22 such as to register with the upper edge 27 of the neck 18 of the bottle 12. In use, when the threadless cap 10 is snapped on the bottle 12, the resilient seal member 11 engages the upper edge 27 of the bottle and creates a leak-proof seal to prevent the liquid from the inside of the bottle 12 from leaking through the threadless cap 10.

In this embodiment, the resilient material is selected to avoid affecting the liquid contained in the bottle 12 in a deleterious manner that may render the liquid unpleasant or harmful to a drinker of the liquid. For example, the resilient material may include a polymer material, which may be approved by a food regulatory authority and/or an environmental regulatory authority.

Figure 7:
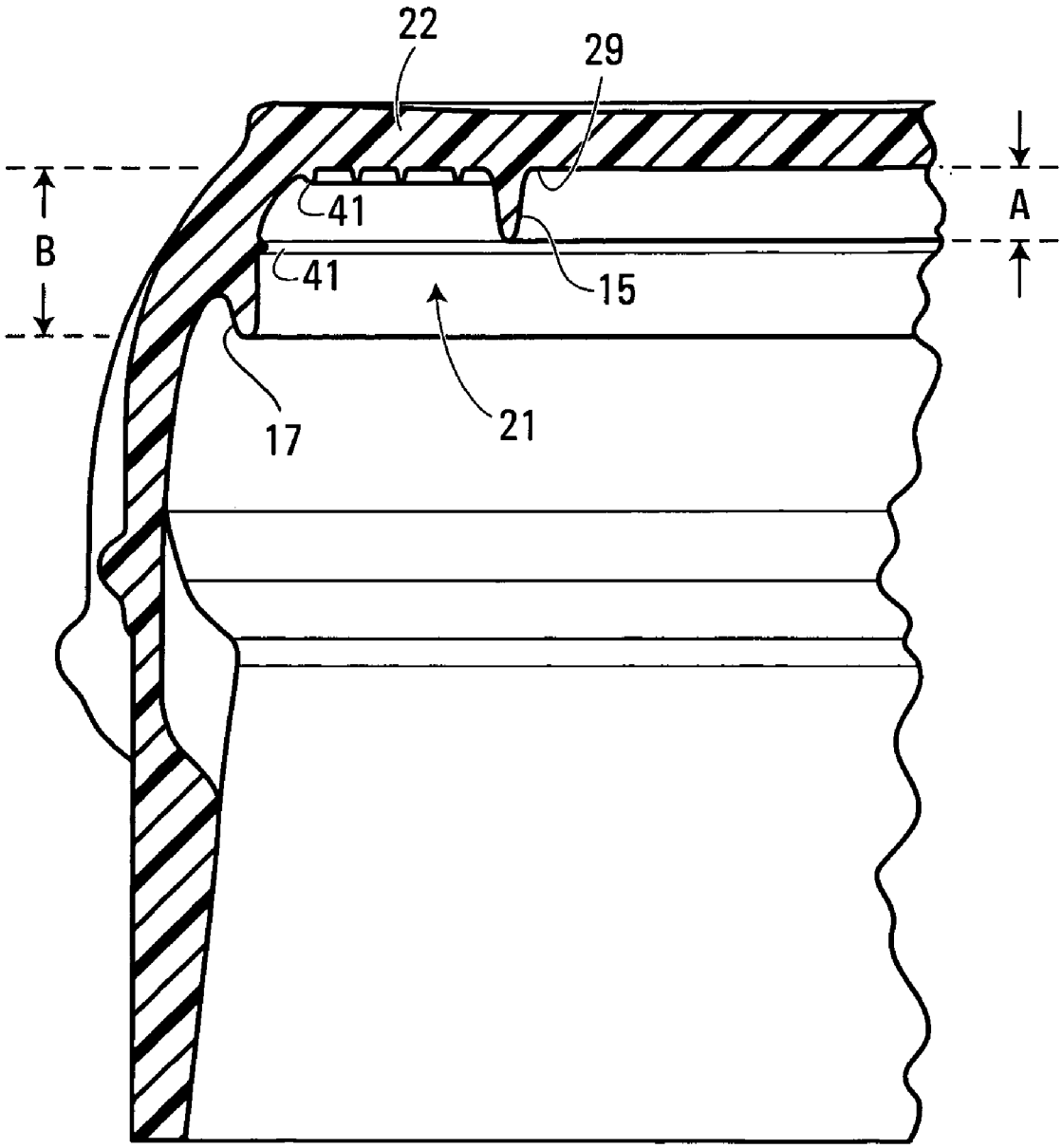
FIG. 7 is a fragmentary vertical cross sectional view of the cap, showing an upper corner of the cap to illustrate a channel for receiving a seal member.

In this example of implementation, the resilient seal member 11 is constrained between two concentric and ring-shaped projections 15 and 17, defining between them a circular channel 21 that is centered on the lid 22. The projection 15 is circular and centered with respect to the lid 22. It is integrally formed with the lid 22. It has a height that is constant along its length and that is less than a height of the resilient seal member 11. By "height" of the ring-shaped projection 15 is meant the distance from the sealing surface 29 to the tip of the ring-shaped projection 15. In the example shown in FIG. 7, this distance is designated by the reference A. In one specific embodiment, the height of the ring-shaped projection 15 is of approximately 1.8 mm. Similarly, the "height" of the resilient seal member 11 is the distance between the sealing surface 29 and the opposite surface of the resilient sealing member 11 that in use engages the upper edge 27 of the bottle 12.

In this fashion, the ring-shaped projection 15 does not interfere the operation of the resilient seal member 11. The resilient seal member 11 can substantially compress against the upper edge 27 without causing the ring-shaped projection 15 to touch the upper edge 27 of the bottle 12.

In this embodiment, the ring-shaped projection 15 is continuous. In a possible variant, the ring-shaped projection 15 may be discontinuous, in other words, it may be made from a series of spaced apart segments.

The projection 17 is also ring-shaped and it is located in the shoulder area of the lid 22. The ring-shaped projection 17 points downwardly. It is also integrally formed with the lid 22. The height of the ring-shaped projection 17 is somewhat less or it is equal to the height of the resilient seal member 11. By "height" of the projection 17 is meant the distance between the sealing surface 29 and the tip of the ring-shaped projection 17. In the example shown in FIG. 7, this distance is designated by the reference B. In one specific embodiment, the height is of approximately 3.1 mm.

As with the ring-shaped projection 15, in this embodiment, the ring-shaped projection 17 is continuous and has a constant height along its length. Alternatively, the ring-shaped projection 17 can be made discontinuous as a series of short segments spaced apart from one another.

In this embodiment, the lid 22 includes a plurality of protuberances 41 in the channel 21 defined by the ring-shaped projections 15 and 17. The protuberances 41 aid to retain the resilient seal member 11 in the channel 21.

As best seen in FIG. 5, the ring-shaped projections 15 and 17 extend along the resilient seal member 11 and engage laterally the resilient seal member 11. In this manner, the resilient seal member 11 is laterally supported. When the resilient seal member 11 engages the upper edge 27 of the bottle 12 and it is compressed against it, the ring-shaped projections 15 and 17 will limit to at least some degree the amount of lateral distortion induced by the compression. Such lateral support is likely to enhance the sealing function of the cap 22 by stabilizing the resilient sealing member 11 when it engages the upper edge 27 of the bottle 12.

Figure 2:
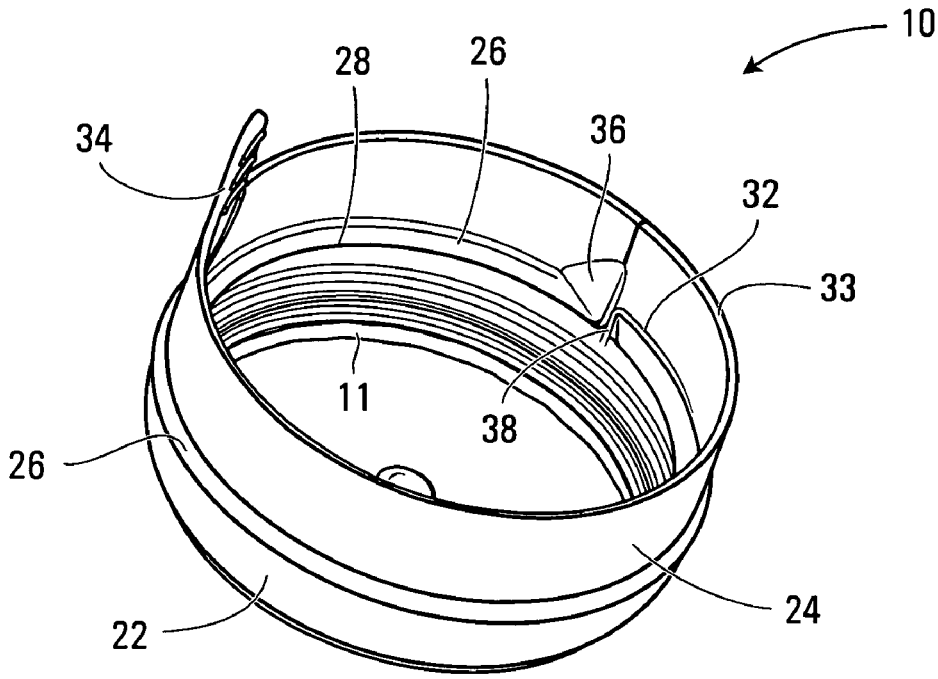
FIG. 2 shows an isometric view of the underside of the threadless cap shown in FIG. 1A.
Figure 3:
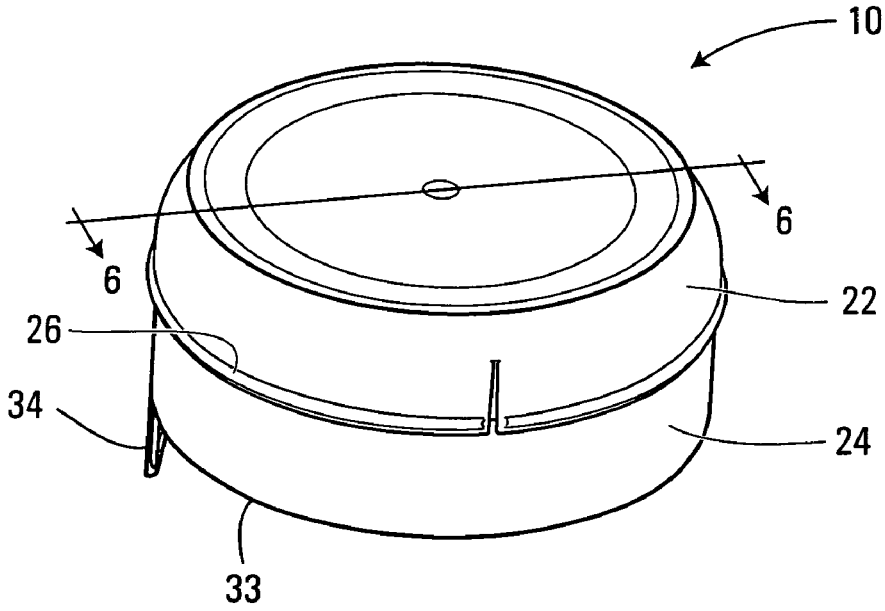
FIG. 3 shows an isometric view of the threadless cap shown in FIG. 1A.
Figure 4:
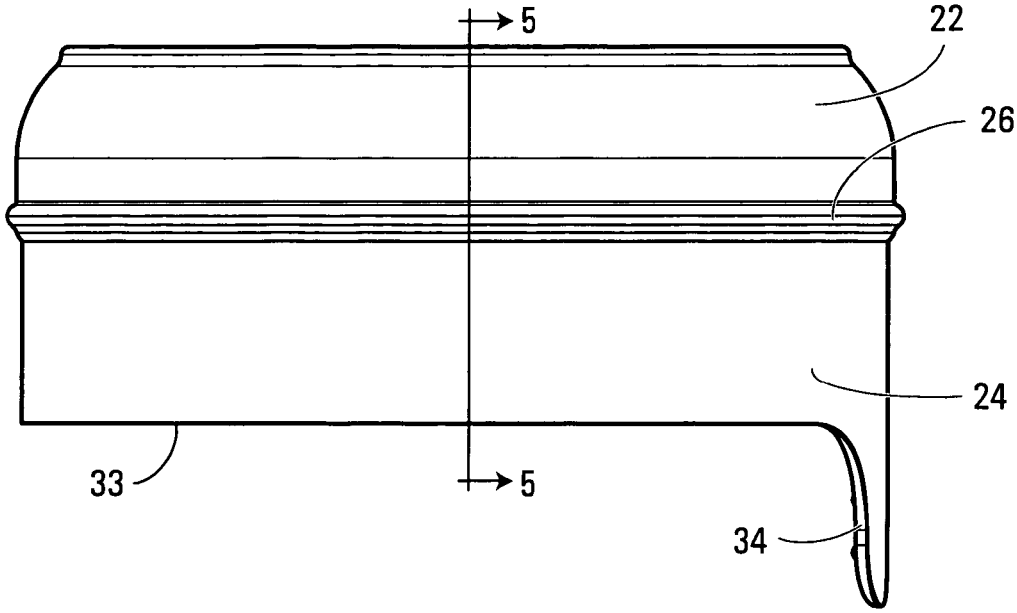
FIG. 4 shows an elevation view of the threadless cap shown in FIG. 3.
Figure 6:
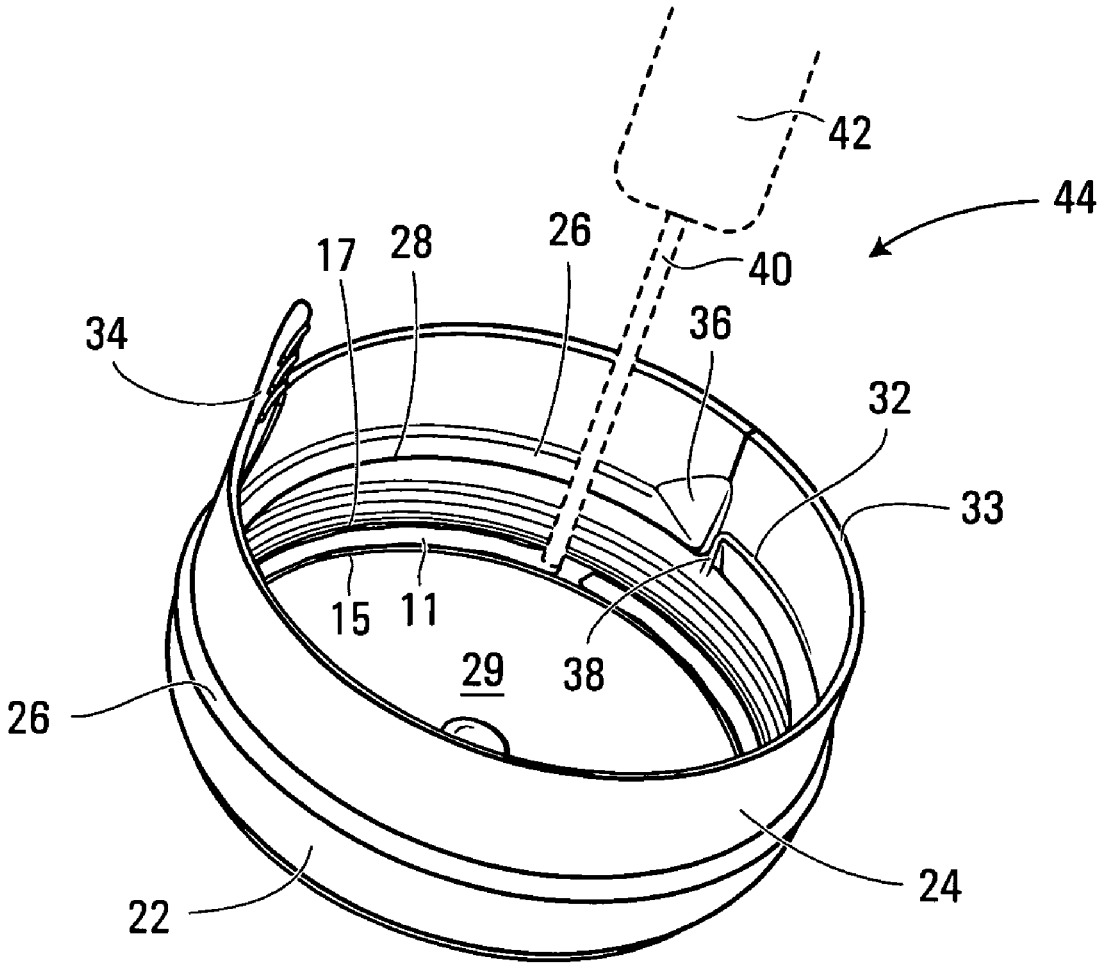
FIG. 6 illustrates a process for laying a bead of resilient material to form a seal member of the threadless cap shown in FIGS. 2 and 5.

A method for forming the resilient seal member 11 is best shown in FIG. 6, which is very similar to FIG. 2 but also shows components of a device used to lay the resilient material. The device for making the resilient seal member 11 has an elongated nozzle 40 which communicates with a supply of resilient material shown schematically at 42. The nozzle 40 is inserted into a threadless cap blank 44 which is to receive the resilient seal member 11 and thus form a completed threadless cap 10. The threadless cap blank 44 is made as a single piece by injection molding or by any other suitable technique. The nozzle 40 is placed in the threaded cap blank 44 and positioned between the ring-shaped projections 15 and 17. As indicated earlier, these projections define the channel 21 in which the resilient material can be delivered. The flow of resilient material from the nozzle 40 is initiated and a bead of resilient material in a paste-like state is deposited in the channel 21. At the same time, a relative rotational movement is created between the nozzle 40 and the cap blank 44 such that a bead of resilient material is uniformly deposited along a path that follows the channel's shape such as to lay a bead of resilient material everywhere in the channel 21. Since the channel 21 is circular, the nozzle 40 is moved along a circular path, at all times the nozzle orifice from where the bead of resilient material is discharged remaining centered within the channel.

As the bead of resilient material is deposited in the channel 21, it is constrained laterally by the ring-shaped projections 15 and 17. In this fashion, the bead of resilient material may be able to flow to some extent lengthwise of the channel but a radial or lateral flow is impeded. This results in a resilient seal member that has an augmented height which is likely to provide a better seal, in particular, one that may accommodate different brands or models of bottles with different bottle neck dimensions. In addition, it is also possible to use with such arrangement a resilient material that has better flow characteristics, such as a resilient material that is less viscous, since the lateral spreading of the resilient material is impeded.

Although the above description related to a specific type of cap, it will be appreciated that the invention can also be applied to caps having other features. For instance, the invention can be applied to a cap which has a lid portion that is pierced when a bottle on which the cap is mounted is installed in a liquid dispenser. The invention can also be applied to caps having a central well as described, for instance, in U.S. Pat. No. 6,032,812. Examples of other threadless caps to which the present invention applies are described in the U.S. Pat. Nos. 5,904,259; 5,392,939; 5,370,270; 5,295,518; 4,991,635 and 4,699,188.

Although various embodiments have been illustrated, this was for the purpose of describing, but not limiting, the invention. Various modifications will become apparent to those skilled in the art and are within the scope of this invention, which is defined more particularly by the appended claims.

The invention claimed is:

1. A threadless cap for closing a liquid bottle, the liquid bottle having a neck with an upper edge defining a discharge opening, said threadless cap comprising:

a) a lid for overlying the upper edge, said lid including:

i) a surface for facing the upper edge; and ii) a first projection extending from said surface toward the upper edge;

b) a skirt depending from said lid; and c) a nonintegral seal member distinct from the other components of the threadless cap and mounted to said surface for establishing a sealing engagement with the upper edge, said seal member including an arcuate bead of resilient material located on said surface in a position to register with at least a portion of the upper edge, said projection engaging and extending along said arcuate bead of resilient material wherein said lid includes a circumferential shoulder portion for engaging the neck of the liquid bottle, said circumferential shoulder portion including a second projection extending along and engaging said arcuate bead of resilient material, said first and second projections define a channel in which is located said arcuate bead of resilient material, wherein said lid includes a plurality of protuberances in said channel, said protuberances being adjacent to each other within said channel when viewed in a cross-section and engaging said seal member to aid in retaining said arcuate bead of resilient material in said channel when the threadless cap is detached from the liquid bottle, and wherein the portion of the surface forming the channel has a relatively horizontal portion from which the first projection extends and a relatively vertical portion from which the second projection extends, and at least one of the protuberances extends inwardly from the relatively vertical portion of the surface at a location above an end of the second projection.

2. A threadless cap as defined in claim 1, wherein said arcuate bead of resilient material is ring-shaped.

3. A threadless cap as defined in claim 2, wherein said first projection is ring-shaped.

4. A threadless cap as defined in claim 3, wherein said arcuate bead of resilient material is continuous.

5. A threadless cap as defined in claim 4, wherein said first projection is continuous.

6. A threadless cap as defined in claim 4, wherein said first projection is discontinuous.

7. A threadless cap as defined in claim 1, wherein said first projection has a height that is less than a height of said arcuate bead of resilient material.

8. A threadless cap as defined in claim 7, wherein said first projection is integrally formed with said lid.

9. A threadless cap as defined in claim 1, wherein each of said first projection and said second projection is ring-shaped.

10. A threadless cap as defined in claim 9, wherein each of said first projection and said second projection is integrally formed with said lid.

11. A threadless cap as defined in claim 1, wherein said arcuate bead of resilient material is made from a material different from a material of said lid.

12. A threadless cap as defined in claim 1, wherein said arcuate bead of resilient material includes a polymer material.

13. A threadless cap as defined in claim 1, wherein said skirt includes a line of weakness for facilitating a manual tear of said skirt.

14. A threadless cap as defined in claim 13, further comprising a tear stop at a location intersecting a line of tear propagating as a result of a manual pull applied on said skirt, said tear stop preventing the line of tear to propagate beyond said tear stop.

15. A threadless cap as defined in claim 1, wherein said lid includes a tension ring for retaining said threadless cap on the neck of the liquid bottle, said tension ring having an inwardly extending rib for engaging the neck of the liquid bottle.

16. A threadless cap as defined in claim 15, wherein said skirt includes a line of weakness for facilitating a manual tear of said skirt.

17. A threadless cap as defined in claim 16, wherein said line of weakness includes a portion extending across said tension ring to reduce a retaining force exerted by said tension ring on the neck of the liquid bottle when a tear line propagating as a result of a manual pull applied on said skirt extends across said tension ring.

18. A blank for a threadless cap, the threadless cap for use in closing a liquid bottle, the liquid bottle having a neck with an upper edge defining a discharge opening, said blank comprising:

a) a lid for overlying the upper edge; and b) a skirt depending from said lid, said lid including:

i) a surface for facing the upper edge;

ii) a channel on said surface for receiving a nonintegral arcuate bead of polymer material capable of setting to form a resilient seal member, said channel being located on said surface in a position to register with at least a portion of the upper edge, said channel including a projection extending from said surface toward the upper edge, said projection defining a barrier to prevent the polymer material deposited in said channel from flowing laterally out of said channel;

wherein said lid includes a plurality of protuberances in said channel, said protuberances being adjacent to each other within said channel when viewed in a cross-section and engaging said resilient seal member to aid in retaining the arcuate bead of polymer material in said channel when the threadless cap is detached from the liquid bottle, and wherein the channel includes a second projection extending from the surface to define the channel, wherein the portion of the surface forming the channel has a relatively horizontal portion from which the first projection extends and a relatively vertical portion from which the second projection extends, and at least one of the protuberances extends inwardly from the relatively vertical portion of the surface at a location above an end of the second projection.

19. A blank as defined in claim 18, wherein said channel is ring-shaped.

20. A blank as defined in claim 19, wherein said projection is ring-shaped.

21. A blank as defined in claim 18, wherein said projection is continuous.

22. A blank as defined in claim 18, wherein said projection is discontinuous.

23. A blank as defined in claim 18, wherein said projection is integrally formed with said lid.

24. A blank as defined in claim 18, wherein said projection is a first projection and wherein said lid includes a circumferential shoulder portion for engaging the neck of the liquid bottle, said circumferential shoulder portion including a second projection extending radially outwardly with respect to said projection, wherein said barrier is a first barrier, said second projection forming a second barrier to prevent polymer material deposited in said channel from flowing laterally out of said channel.

25. A blank as defined in claim 24, wherein each of said first projection and said second projection is ring-shaped.

26. A blank as defined in claim 24, wherein each of said first projection and said second projection is integrally formed with said lid.

27. A blank as defined in claim 18, wherein said skirt includes a line of weakness for facilitating a manual tear of said skirt.

28. A blank as defined in claim 27, further comprising a tear stop at a location intersecting a line of tear propagating as a result of a manual pull applied on said skirt, said tear stop preventing the line of tear to propagate beyond said tear stop.

29. A blank as defined in claim 18, wherein said lid includes a tension ring for retaining the threadless cap on the neck of the liquid bottle, said tension ring having an inwardly extending rib for engaging the neck of the liquid bottle.

30. A blank as defined in claim 29, wherein said skirt includes a line of weakness for facilitating a manual tear of said skirt.

31. A blank as defined in claim 30, wherein said line of weakness includes a portion extending across said tension ring to reduce a retaining force exerted by said tension ring on the neck of the liquid bottle when a tear line propagating as a result of a manual pull applied on said skirt extends across said tension ring.

* * * * *